US005983545A

United States Patent [19]

Marco

[11] Patent Number: 5,983,545

[45] Date of Patent: Nov. 16, 1999

[54] COLLAPSIBLE POSTER DISPLAY DEVICE

[75] Inventor: Laurent Marco, Paris, France

[73] Assignee: Societe Profil Industrie, Montrouge, France

[21] Appl. No.: 09/051,431

[22] PCT Filed: Oct. 9, 1996

[86] PCT No.: PCT/FR96/01574

§ 371 Date: Apr. 9, 1998

§ 102(e) Date: Apr. 9, 1998

[87] PCT Pub. No.: WO97/14132

PCT Pub. Date: Apr. 17, 1997

[30] Foreign Application Priority Data

Oct. 9, 1995 [FR] France ..... 95 11879

[51] Int. Cl.[6] ..... G09F 17/00

[52] U.S. Cl. ..... 40/610; 40/603; 248/176.1

[58] Field of Search ..... 40/603, 604, 606, 40/610; 248/176.1

[56] References Cited

U.S. PATENT DOCUMENTS 1,699,735 1/1929 Dabrohua et al. ..... 40/603
4,700,498 10/1987 Perutz et al. ..... 40/603

FOREIGN PATENT DOCUMENTS 576752 5/1933 Germany ..... 40/603

*Primary Examiner*—Cassandra H. Davis
*Attorney, Agent, or Firm*—Young & Thompson

[57] ABSTRACT

A lightweight assembly (1) suitable for displaying a poster (2) and erected without the use of tools by assembling a set (J) of members. The assembly includes two side members (3), a transverse base member (4), two crossbar members (5), four flexible upright members (6), a central member (7), a device (8) for assembling an H-shaped base, and a substantially X-shaped upright structure (6, 7) erected on the base (3, 4) and curved inwards towards the poster. The crossbar members (5) are arranged between the legs (3) of the base and between the flexible members (6).

18 Claims, 2 Drawing Sheets

FIG. 1
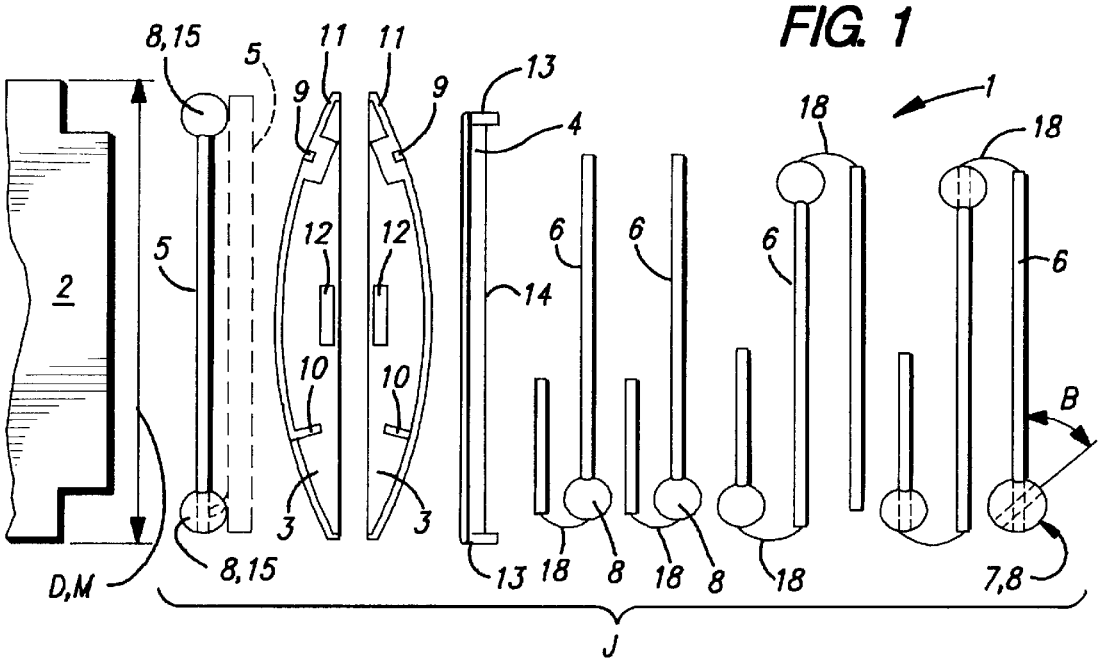
FIG. 2
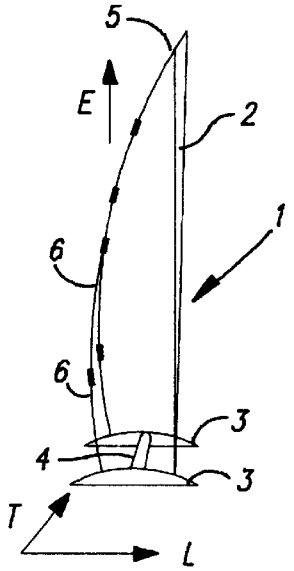
FIG. 3
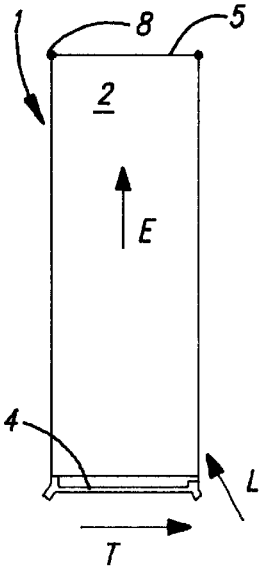
FIG. 4
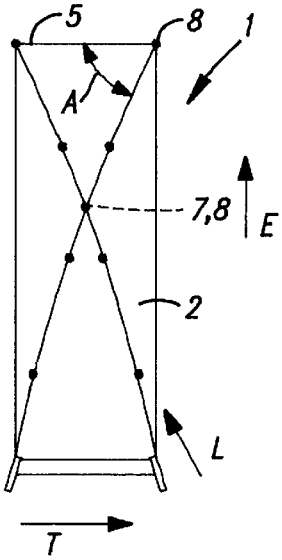
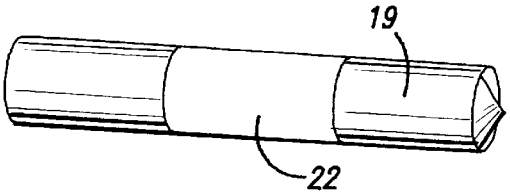
FIG. 5

COLLAPSIBLE POSTER DISPLAY DEVICE

The invention concerns a set of members intended to form, with a poster in particular, a furniture to display the poster; such a furniture; a unit for packaging such a set and/or furniture; as well as a transport device.

Document EP-A-2311.447 provides for an adjustable and portable display apparatus, capable of being arranged in either a working position or a non working position. In the latter position, the apparatus forms a unit, obtained by folding, for intermediate storage.

Vertical supporting members, for example telescopic, cooperate with vertical structural members to hold up elastic bars. Pivoted connections connect certain members, while structural foot members are provided with protruding pins, dimensioned so as to be housed in vertical elements.

Document DE-U-91.09.866 provides for metal tubes secured by a plastic ring, to obtain an adjustable support for photographs or postcards.

Document U.S. Pat. No. 4,866,866 describes a portable and foldable signboard, having feet connected to a central part by pivot pins. A sheet of fabric or plastic is supported between the central part and the feet, the latter being equipped with sliding points, to be driven into the ground so as to quickly erect the signboard.

Document DE-U-93.01.769 describes a display device ensuring an upright position.

It comprises a foot and side parts and several transversal links. Various supports and a transversal link, such as metal tubes 9 mm in diameter and 590 to 2,500 mm long, are mounted on the foot so as to form an H-shaped frame.

Two cables respectively stretched between the ends of the supports allow for the installation of two U-shaped aluminium sections to hold up the display stand. The foot, the frame and the sections are mutually secured by means of stop rings and/or screws.

Document GB-A-2 277 340 concerns a foldable panel, for road traffic.

The known structures have certain disadvantages.

In general, the weight of such structures, for example in the order of 15 kg, make their handling and transportation difficult. This disadvantage is increased when it is necessary to transport groups of several structures, such as for an exhibition.

In a similar manner, most known structures are inappropriate for postal parcels.

For example, in the case of document DE-U-93.01.769, the components of the device have heterogeneous dimensions, such as a thick and short foot while the metal tubes are thin and long.

Broadly speaking, this creates packaging and/or transportation problems.

In addition, it is common to lose small pieces, such as screws, stop rings or similar.

Such pieces slow down the mounting/dismounting of the structure, and make the latter more complex, heavy and expensive.

With a structure such as that of document EP-A-231.447, which provides for assembly by sliding pins inside tubes, there are risks of ill-timed disassembly or dismounting.

For example, under the effect of a lateral impact towards the exterior of the foot element, the apparatus may collapse, which is dangerous and interrupts the display.

In spite of their weight, certain devices lack rigidity, especially lateral rigidity. The structures equipped with a transversal link between two side parts, or the rectangular frames, tend to have this disadvantage.

The goal of the invention is to eliminate these problems in particular.

It also aims, among other things, to propose a furniture which is:

light;

easily mounted/dismounted;

inexpensive;

capable of being stored so as to occupy a volume of limited dimensions and in a practical manner;

highly stable and/or rigid with respect to its dimensions and weight; and capable of automatically ensuring an optimal coherence and state of tension for the poster.

For this purpose, a first object of the present invention is a set of members intended to form, with a poster in particular, a light furniture to display the poster, by assembling the members without tools; characterised in that the set includes a combination of at least the following:

two lateral base members or feet;

a transversal base member;

two transversal rod members, one referred to as lower, the other as upper;

four flexible erecting tube members;

a central knot member, at one end of a flexible member;

integrated means of assembly by nesting, such as complementary male and/or female shapes, being provided on each member with a view to assembling, respectively: a base with the transversal member between the two feet; an erecting structure on the base, substantially X-shaped, with each flexible member extending from the knot member; the rod members, lower and upper, respectively, being assembled between the feet of the base and, erected and opposite, between the flexible members;

each member, extending mainly along a direction referred to as the length, having a maximum dimension substantially uniform in the dismounted state, for example in the order of 600 to 1,000 mm and/or close to a transversal dimension of the poster to be displayed;

the means of assembly of the base members with one another being arranged so as to allow for nesting along a secant direction with respect to the length of these members, for example substantially perpendicular.

According to one embodiment, at least one foot and/or transversal base member comprises, or consists of, a metal piece, for example welded, lamellar cut-outs of sheet steel such as stainless steel and/or coated with polyurethane paint or similar, the two feet possibly being substantially symmetrical with respect to a transversal erecting plane and/or identical, so as to be interchangeable.

Depending on its length, at least one foot and/or transversal member comprises front means of assembly, such as a reverse-lock transversal notch for a rod member and/or rear means of assembly for a flexible member, such as an erecting housing, for example with such means opening into the convexity of the cylinder-shaped section of a top face of a foot.

In one embodiment, at least one foot and/or transversal base member comprises means of assembly with the transversal member, with a foot, respectively, such as a front or rear central lug formed in a lateral erecting blank and providing an inner nesting groove along a direction of erection, from top to bottom.

According to one embodiment, the means of assembly with a foot, with a transversal member, respectively, of the transversal base member and/or foot include at least one lateral erecting bracket, nesting into a groove protruding from a bottom face, and for example a bracket at each end along the length of a transversal member shaped like a horizontal C.

One set provides for at least one rod member to comprise a carbon fibre tube piece of which each lateral end lengthwise is equipped with means of assembly with a flexible member or a base member, such as an element made of injection moulded plastic material (styrene butadiene acrylonitrile or another synthetic material) with nesting channels, for example shaped like a cylinder section of approximately 40 mm in diameter with bellied faces.

In one example, one of the channels of the moulded element opens onto both sides, substantially along the length of the rod member, with the other extending substantially along a nesting direction which forms an angle in the order of 60 to 80°, for example in the order of 72.5°, with respect to the length.

In one set, at least one rod member comprises a piece of synthetic material or metal with means of assembly with a flexible member or with a base member substantially at each lateral end lengthwise and/or, along the latter, a flap forming an upper channel with a lateral section shaped like an open P.

One set includes an upper rod member shaped like a tube and a lower rod member shaped like an open P, intended to be joined to a rear face of the poster, by bonding or similar.

According to one embodiment, each flexible member includes at least two carbon fibre tube pieces with, at least at one lateral end of a tube lengthwise, means of assembly with another tube, such as an element made of injection moulded synthetic material, for example shaped like a cylinder section of approximately 40 mm diameter having bellied faces, with a rectilinear traversing nesting channel, several tubes of a flexible member being possibly connected by an internal elastic cord.

One set provides, for example, for two flexible members referred to as lower and long, each comprising three tubes, connected, two of which have a substantially uniform dimension lengthwise and the other approximately half of this dimension, whereas two other members, referred to as upper and short, each include two tubes, connected, one of which has a dimension substantially equal to the uniform dimension lengthwise and the other approximately half of this dimension.

In one embodiment, the central member or knot comprises, or consists of, an element made of injection moulded plastic material (styrene butadiene acrylonitrile or another synthetic material) with nesting channels traversing crosswise, for example shaped like a cylinder section of approximately 50 mm in diameter with bellied faces.

For example, two nesting channels form an acute angle of approximately 40°, predetermined so that the nesting of the two flexible members to be assembled, the lower one with the base and the upper one with a rod opposite to the knot, respectively, will be performed locally along similar directions of orientation.

A second object of the invention is a light furniture to display a poster, consisting of a set of members assembled without tools.

It includes a combination of at least the following: a poster provided with a transversal fold at at least one of its ends along a direction of erection; two lateral base members or feet; a transversal base member; two transversal rod members, one referred to as lower housed in a fold or joined to the bottom of the poster, the other referred to as upper housed in the other fold; four flexible erecting tube members; a central knot member, at one end of a flexible member; integrated means of assembly by nesting to assemble, respectively: an H-shaped base with the transversal member between the two feet; an erecting structure on the base, shaped substantially like an X curved inwards with its concavity towards the poster, with each flexible member extending from the knot member; the rod members, lower and upper, respectively, being assembled between the feet of the base and, erected and opposite, between the flexible members;

the means of assembly of the base members with one another being arranged so as to allow for nesting along a secant direction with respect to the length of these members, for example substantially perpendicular;

whereas the means of assembly of the flexible members, the rod members and the base are conformed so as to give rise to a constant tension of the structure and the poster, due to their arrangement offset and/or locally secant with respect to a length of a nested member at a distance from these means of assembly.

One embodiment provides for the means of assembly of the flexible members, the rod members and the base to be conformed so as to give rise to a balanced tension, due to their arrangement offset and/or locally secant with respect to a length of a nested member, at a distance from these means of assembly, symmetrically within the furniture.

Typically, such a furniture is obtained with a set of members such as mentioned above.

The poster is made of cellulose material such as paper, synthetic material such as polyester or similar, woven or nonwoven, its dimensions being approximately 2,100 mm in height and 600, 800 or 1,000 mm transversally.

A third object of the invention is a packaging unit.

It comprises a set of members or a dismounted furniture such as mentioned above.

It also comprises a container such as a cylindrical tube, for example made of cardboard, having a diameter in the order of 120 mm and an edge dimension in the order of 630, 830 or 1,030 mm.

One packaging unit is provided with a sheet made of cellulose material such as cardboard, synthetic material such as polyester, polyvinyl chloride or similar, between the rolled poster and the members arranged in a bundle, the latter being surrounded by the sheet, which is also rolled, with information such as the mounting/dismounting procedure, the list of components of the furniture or similar being printed on the sheet.

In one embodiment, an outer face of the packaging is provided with an area for receiving inscriptions, such as a label, adhesive for example, for inscriptions such as advertisements and/or a bar code and/or a dispatching address and/or a postmark or similar.

A fourth object of the invention is a transport device containing at least one packaging unit and/or a set of members and/or a dismounted furniture, possibly inside a bag made of fabric containing the tube and/or the set of members and/or the poster.

In one example, the transport device comprises a substantially prismatic rectangular container, equipped with a cover, hinged or similar, and/or lifting handles and/or moving castors, for example turning freely.

The invention will now be described in detail, with reference to the attached drawings which show various embodiments.

In the drawings, FIG. 1 is a top and exploded view of a set of members in accordance with the invention, in which one of the two rod members is shown in dashed lines, with part of a poster designed for such a set also partially illustrated.

FIG. 2 is a side perspective view of a furniture according to the invention.

FIG. 3 is a front perspective view of a furniture according to the invention.

FIG. 4 is a rear perspective view of a furniture according to the invention.

FIG. 5 is a perspective view of a packaging unit according to the invention.

Figure 11:
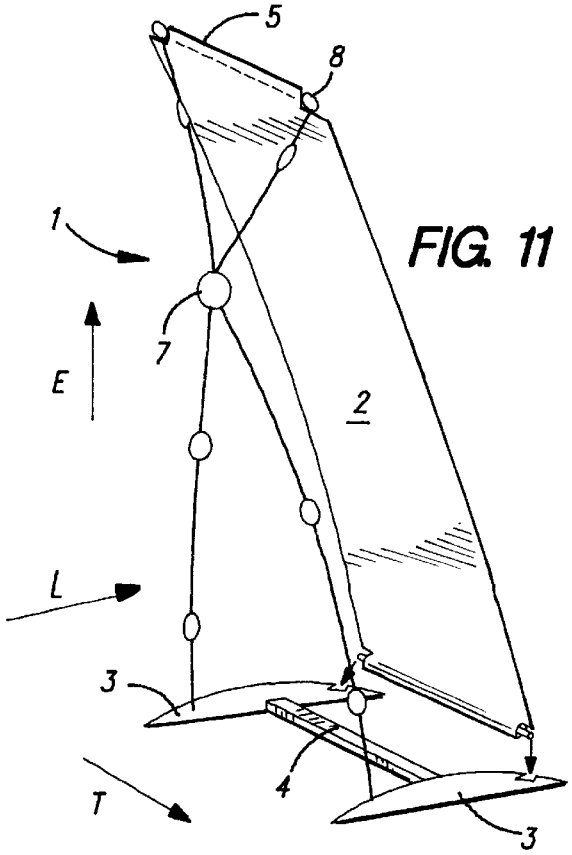

And FIG. 11 is a perspective, three-quarter rear view of a furniture according to the invention, in the process of being mounted, during the assembly of the lower rod member and the base.

FIGS. 2 to 4, 6 and 11 show three directions L, T and E perpendicular to one another.

Direction L is referred to as the lateral direction, direction T is the transversal direction, and direction E is the direction of erection.

They define the main directions chosen to describe the invention. These directions may take on any orientation whatsoever in space.

For the sake of simplicity, in the description of a furniture 1, it is considered that direction L conventionally corresponds to a depth of the furniture seen from the front, as in FIG. 3.

Whereas direction T corresponds to its width, and direction E corresponds to its height. Directions L and T therefore define a plane considered as being parallel to a bearing surface on which the furniture 1 is resting, in display position. In the case of the ground for example, the bearing surface is then horizontal.

But, once again, this does not limit the scope of the invention in any way whatsoever.

It is also advisable to distinguish the respective positions and/or orientations of the components of the invention, on the one hand in a dismounted state, in the form of a set of members as in FIG. 1.

And, on the other hand, in a mounted or display state, as in FIGS. 2 to 3 and 11. In this case, reference is sometimes made to directions L, T and E for the separate components, exclusively as target directions in the mounted furniture 1 and so as to simplify the description.

FIG. 1 shows a set J of members intended to form, with a poster 2 in particular, a light furniture 1 to display the poster, by assembling the members without tools.

The set J comprises:

two lateral base members or feet 3;

a transversal base member or crosspiece 4;

two transversal rod members 5, one referred to as lower, the other as upper;

four flexible erecting tube members 6;

a central knot member 7, at one end of a flexible member 6.

In the present description, the term "flexible" indicates that the members or tubes 6 may undergo a certain elastic deformation, particularly bending. Nevertheless, they have a specific rigidity, particularly lengthwise, which allows them to be self-supporting, as opposed to a chain or a cable.

Integrated means of assembly 8 by nesting, such as complementary male and/or female shapes, are provided on each member 3, 4, 5, 6 or 7.

The means 8 make it possible to assemble, respectively: a base with the transversal member 4 between the two feet 3; an erecting structure on the base 3, 4, substantially X-shaped, with each flexible member 6 extending from the knot member 7; the rod members 5, lower and upper, respectively, being assembled between the feet 3 of the base and, erected and opposite, between the flexible members 6.

FIG. 1 shows that each member, extending mainly along a direction D referred to as the length, has a maximum dimension M substantially uniform in the dismounted state, for example in the order of 600 to 1,000 mm. This dimension M is close to a transversal dimension of the poster 2 to be displayed.

The means of assembly of the base members 3, 4 with one another are arranged so as to allow for nesting along the secant direction E with respect to the length (FIG. 1) of these members 3, 4. In this example, direction E is substantially perpendicular to direction D lengthwise, once the furniture 1 has been mounted.

According to one embodiment, at least one foot 3 consists of a metal piece, made up of welded, lamellar cut-outs of sheet steel such as stainless steel, coated with polyurethane paint or similar. In this example, the two feet 3 are substantially symmetrical with respect to a transversal erecting plane (L, E), so as to make the left foot 3 and right foot 3 interchangeable.

Depending on its length, each foot 3 comprises front means of assembly 8, in this example a reverse-lock transversal notch 9 for a rod member 5. In this example, rear means of assembly 8 for a flexible member 6 consist of an erecting housing 10. In this example, these means 8 open into the convexity of a top face 11 with a cylinder-shaped section on each foot 3.

In FIG. 1, each foot 3 of the base comprises a means of assembly 8 with the transversal member 4 or crosspiece. It consists of a central lug 12, formed in a lateral erecting blank and providing an inner nesting groove along a direction of erection, from top to bottom. The groove is arranged on a plane parallel to directions T and L, extending substantially along the latter.

The means of assembly 8, with a foot 3, of the transversal base member 4, include at least one lateral erecting bracket 13, nesting from top to bottom into a groove corresponding to the lug 12 and protruding from a bottom face 14. In FIG. 1, a bracket 13 protrudes at each end along the length of the transversal member 4, giving it the shape of a horizontal C when it is positioned on the mounted furniture 1.

In FIG. 1, the set J provides, to the left, for a rod member 5 which comprises a carbon fibre tube of which each lateral end lengthwise is provided with means of assembly 8 with a flexible member 6. In this example, these means 8 consist of an element 15 made of injection moulded plastic material (styrene butadiene acrylonitrile or another synthetic material) of approximately 40 mm in diameter with bellied faces, with nesting channels (shown in dotted lines) shaped like a cylinder section.

One of the channels of the moulded element 15 opens onto both sides, substantially along the length of the rod member 5. The other extends substantially along a nesting direction which forms an angle in the order of 60 to 80°, for example in the order of 72.5°, with respect to the length. This angle is indicated as "A" in FIG. 3.

In the set illustrated, at least one rod member 5 comprises a piece of synthetic material or metal with means of assembly 8 substantially at each lateral end lengthwise.

Examples of such members 5 made of extruded polyvinyl chloride are illustrated in FIGS. 7 to 9 and 10.

Along the length (D, M), a flap forming an upper channel with a lateral section shaped like an open P is provided. It receives the carbon tube, whereas a flat part 17 forms a joining surface intended to be assembled by welding, bonding, cramping or similar with a rear face of a poster 2.

Other sets include an upper and lower rod member shaped like a tube, as in the case of the furniture of FIG. 11.

Each flexible member 6 includes at least two carbon fibre tube pieces with, at one lateral end of a tube lengthwise, means of assembly 8 with another tube, in this example an element made of injection moulded synthetic material with a rectilinear traversing nesting channel, or otherwise similar to the element 15 of the carbon tube members 5. The tubes of a flexible member are connected by an elastic cord 18, so as to form an indissociable member 6.

The set J provides, in FIG. 1, to the right, for two flexible members 6 referred to as lower and long, each comprising three tubes, two of which have a substantially uniform dimension lengthwise and the other approximately half of this dimension. Two other members 6, referred to as upper and short, each include (see FIG. 1, to the left) two tubes, one of which has a dimension substantially equal to the uniform dimension lengthwise and the other approximately half of this dimension. This uniform dimension is substantially equal to dimension M.

The central member 7 or knot consists of an element made of injection moulded plastic material (styrene butadiene acrylonitrile or another synthetic material) shaped like a cylinder section of approximately 50 mm in diameter with bellied faces. The dotted lines in FIG. 1 show means 8 defining nesting channels traversing crosswise.

The latter consist of two nesting channels forming an acute angle B of approximately 40°, predetermined so that the nesting of the two flexible members 6 to be assembled, the lower one with the base and the upper one with a rod opposite to the knot, respectively, will be performed locally along similar directions of orientation.

The furniture 1 obtained with a set J is light and is used to display a poster 2 or "display". It is assembled without tools in a simple and quick manner.

The furniture 1 of FIG. 11 consists of: a poster 2 provided with a transversal fold at each of its ends along the direction of erection E; two lateral base members 3; a transversal base member 4; two transversal rod members 5, one referred to as lower housed in a fold, the other referred to as upper housed in the other fold; four flexible erecting tube members 6; a central knot member 7, at one end of a flexible member 6; integrated means of assembly 8.

During mounting, the following are successively assembled: an H-shaped base with the transversal member 4 between the two feet 3; an erecting structure 6, 7 on the base, shaped substantially like an X curved inwards with its concavity towards the poster 2, with each flexible member 6 extending in a cross from the knot member 7; the rod members 5, lower and upper, respectively, being assembled between the feet 3 of the base and, erected and opposite, between the flexible members 6.

The means of assembly 8 of the base members with one another are arranged so as to allow for nesting along direction E and from top to bottom. This avoids ill-timed disassembly.

The means of assembly 8 of the flexible members 6, the rod members 5 and the base 3, 4 are conformed so as to give rise to a constant tension of the erecting structure (6, 7 and upper members 5) and the poster 2.

This result is obtained through the arrangement of the means 8, which is offset and/or locally secant with respect to a length of a nested member at a distance from these means of assembly.

In particular, this brings about a two-fold longitudinal bending of the members 6, one shown in FIG. 2 along direction L, the other shown in FIG. 4 along direction T. And the poster 2, via the members 5, keeps the erecting structure 6, 7 in tension. In return, the poster 2 itself is also subject to tension.

FIG. 4 (or 11) clearly shows that the means of assembly 8 of the flexible members 6, the rod members 5 and the base 3, 4 are conformed so as to give rise to a balanced tension. This is obtained through their predetermined and symmetrical arrangement within the furniture 1. Indeed, the erecting structure defines an X whose branches 6 are curved inwards with their back towards the exterior.

The poster 2 is made of a cellulose material such as paper, synthetic material such as polyvinyl chloride, referred to as "PVC", or similar, woven or nonwoven. Its dimensions are approximately 2,100 mm in height and 600, 800 or 1,000 mm transversally.

FIG. 5 shows a packaging unit 19.

Although this is not shown, it comprises a set J of members and therefore a dismounted furniture 1.

In this example, the unit 19 is a cylindrical tube container, made of cardboard, with a diameter in the order of 120 mm and an edge dimension in the order of 830 mm. It is intended for a poster measuring 800 mm along direction T.

Within a packaging unit 19, a sheet 20 is provided. In this example, this sheet is made of synthetic material such as PVC, polyester or similar. In the unit 19, the sheet 20 is between the rolled poster 2 and the members 3, 4, 5, 6, 7 arranged in a bundle (the latter are surrounded by the sheet, which is also rolled).

Information such as the mounting/dismounting procedure, the list of components of the furniture 1 or similar is printed on the sheet 20.

Figure 7:
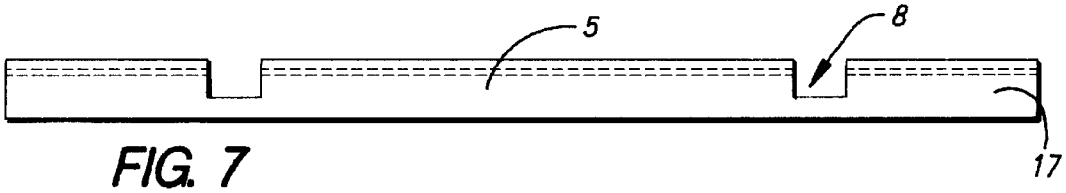
FIGS. 7, 8 and 9 are front views of the three embodiments of rod members made of synthetic material such polyvinyl chloride or "PVC" (obtained by moulding and/or extrusion), for posters with transversal dimensions, on the furniture, of 1,000, 800 and 600 mm, respectively.
Figure 8:
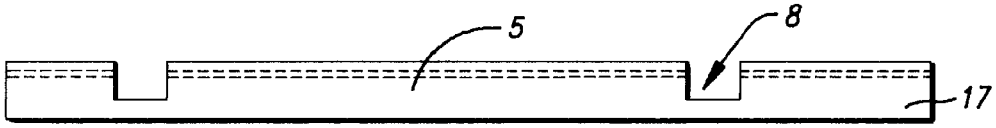
Figure 9:
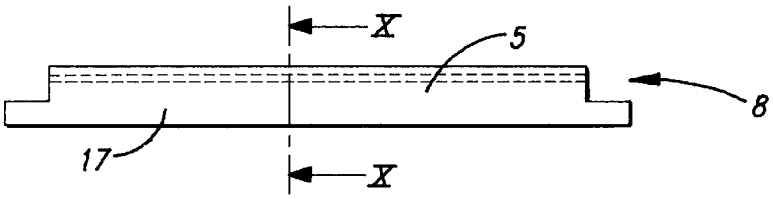
Figure 10:
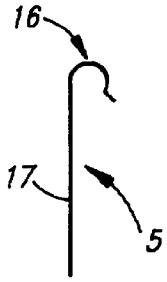
FIG. 10 is a sectional side view, perpendicular to the length of the rod member of FIG. 9, along line X of the latter.
Figure 6:
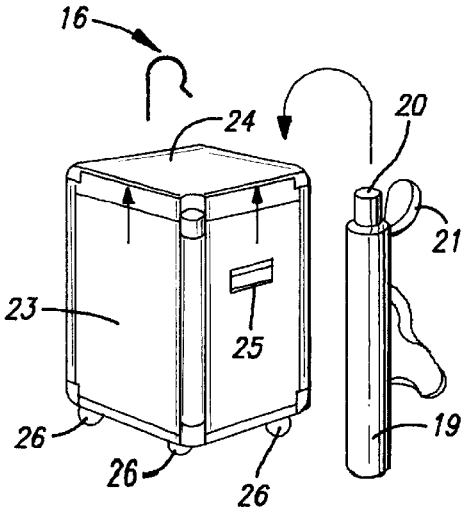
FIG. 6 is a perspective view of a transport device and of a packaging unit in the form of bag made of fabric, according to the invention, which partially shows a rolled protective sheet.

In FIG. 6, which shows the sheet 20, the unit 19 comprises a bag made of synthetic fabric with a shoulder strap, and including an end cap 21 which can be closed by means of a peripheral zip fastener. In this example, a tube is accommodated inside the bag.

In FIG. 5, an outer face of the packaging unit 19 is provided with an area 22 for receiving inscriptions, such as a label, adhesive for example. The area 22 is intended for inscriptions such as advertisements and/or bar codes and/or dispatching addresses and/or postmarks or similar.

It is understood that, since the component members 3, 4, 5, 6, 8 have a homogeneous maximum dimension, chosen to be close to the maximum dimension of the poster 2 rolled along its longest edge, it is easy to form a bundle with the dismounted furniture 1.

Such a bundle, which is compact and light (for example, in the order of 3 kg), can be easily slid into a rigid packaging such as the tube 19. Plugs can then seal off its ends. The unit obtained (1, 19) has a format readily accepted by postal, routing or express mail services. Dispatching costs are therefore low.

FIG. 6 shows a transport device 23 containing at least one packaging unit 19 and/or a set J of members and/or a dismounted furniture 1 (possibly inside a bag made of fabric containing the tube and/or a tube).

In one example, this device 23 comprises a substantially prismatic rectangular container, equipped with a cover 24 with hinges, a lock or similar, and lifting handles 25. Moving castors 26 are also shown, for example turning freely, to roll the container or device 23, for example to an exhibition site where several pieces of furniture 1 are extracted and then mounted.

I claim:

1. A stand for displaying a poster, comprising:

a base comprising two lateral base members and a transverse base member removably connecting said two lateral base members;

an X-shaped structure extending from said base and comprising four flexible poles removably attached to a central member that has four female fittings receiving respective first ends of said four poles, wherein second ends of a first pair of said poles are removably attached to first female fittings in respective lateral base members;

an upper transverse rod and a lower transverse rod, ends of said lower transverse rod being removably attached to second female fittings in respective lateral base members; and connectors having female fittings removably attaching ends of said upper transverse rod and second ends of a second pair of said poles.

2. The stand of claim 1, wherein said lateral base members are interchangeable.

3. The stand of claim 1, wherein said first female fittings of said lateral base members are adjacent first ends of said lateral base members and said second female fittings of said lateral base members are adjacent second ends of said lateral base members opposite said first ends.

4. The stand of claim 1, wherein said lateral base members comprise slots for receiving respective ends of said transverse base member.

5. The stand of claim 4, wherein ends of said transverse base member each comprise a bracket inserted through a respective one of said slots.

6. The stand of claim 1, wherein said connectors attach the ends of said upper transverse rod and said second ends of said second pair of said poles with an angle of 60–80° therebetween.

7. The stand of claim 1, wherein at least one of said upper and lower transverse rods comprises a depending flap having a hook shape.

8. The stand of claim 1, wherein said lateral and transverse base members and said four poles and said upper and lower transverse rods have a substantially uniform length.

9. The stand of claim 8, wherein said uniform length is 600 to 1000 mm.

10. The stand of claim 1, wherein said four poles each comprise plural detachable sections.

11. The stand of claim 10, wherein said lateral and transverse base members and said upper and lower transverse rods have a substantially uniform length and wherein plural said sections have said uniform length and plural said sections have a length that is about one-half said uniform length.

12. The stand of claim 1, further comprising the poster, said poster having a length that is less than a fully erect height of said X-shaped structure, so that when said poster is on said stand, said X-shaped structure is bent into an arc-like shape.

13. The stand of claim 12, wherein one longitudinal end of said poster is attached to said upper transverse rod and another longitudinal end of said poster is attached to said lower transverse rod.

14. The stand of claim 1, further comprising a cylindrical tube for carrying said stand when it is not assembled.

15. A stand and a poster therefor, comprising:

a poster having a first length;

an H-shaped base comprising two lateral base members and a transverse base member;

an X-shaped structure extending from said base a second length greater than said first length and comprising plural flexible poles, wherein ends of two of said poles are removably attached to first female fittings in respective lateral base members;

an upper transverse rod at one end of said poster and a lower transverse rod at another end of said poster, ends of said lower transverse rod being removably attached to second female fittings in respective lateral base members; and connectors having female fittings removably attaching ends of said upper transverse rod and ends of two of said poles, said X-shaped structure being flexed into an arcuate shape between said connectors and said H-shaped base by tension caused by the difference between said first and second heights.

16. The stand and poster of claim 15, wherein said X-shaped structure comprises four flexible poles removably attached to a central member that has four female fittings receiving respective first ends of said four poles, wherein second ends of a first pair of said poles are removably attached to said first female fittings in said respective lateral base members.

17. The stand and poster of claim 15, wherein said first female fittings of said lateral base members are adjacent first ends of said lateral base members and said second female fittings of said lateral base members are adjacent second ends of said lateral base members opposite said first ends.

18. The stand and poster of claim 15, wherein said lateral and transverse base members and said upper and lower transverse rods have a substantially uniform length and wherein plural said poles comprise first sections having said uniform length and second sections having a length different than said uniform length.

* * * * *